United States Patent [19]

Knobloch et al.

[11] Patent Number: 4,875,628

[45] Date of Patent: Oct. 24, 1989

[54] METHOD AND APPARATUS FOR CRUSHING BRITTLE MATERIAL FOR GRINDING

[75] Inventors: Osbert Knobloch, Rheda-Wiedenbrück; Manfred Müller, Ennigerloh, both of Fed. Rep. of Germany

[73] Assignee: Krupp Polysius AG, Fed. Rep. of Germany

[21] Appl. No.: 191,077

[22] Filed: May 6, 1988

[30] Foreign Application Priority Data

May 27, 1987 [DE] Fed. Rep. of Germany ..... 3717975

[51] Int. Cl.[4] ..... B02C 23/12

[52] U.S. Cl. ..... 241/24; 241/80; 241/101 B

[58] Field of Search ..... 241/80, 152 A, 97, 24, 241/29, 79.1, 101 B

[56] References Cited

U.S. PATENT DOCUMENTS 3,806,046 4/1974 Kouloheris et al. ..... 241/29 X
3,951,347 4/1976 Tiggesbaumker et al. ..... 241/80 X
4,728,044 3/1988 Duill et al. ..... 241/80 X

FOREIGN PATENT DOCUMENTS 84383 7/1983 European Pat. Off. .

*Primary Examiner*—Mark Rosenbaum
*Attorney, Agent, or Firm*—Learman & McCulloch

[57] ABSTRACT

The invention relates to a method and to apparatus for crushing brittle material for grinding using a material bed roll mill, in which at least a proportion of the branch stream returned to the roll gap is dried to such an extent that a mixed moisture content which lies below a critical moisture content is produced in the roll gap. In this way it is possible even for material for grinding which has a high moisture content and above a critical moisture value has a tendency to sticking and/or caking on to be crushed satisfactorily.

16 Claims, 2 Drawing Sheets

METHOD AND APPARATUS FOR CRUSHING BRITTLE MATERIAL FOR GRINDING

The invention relates to a method and apparatus for crushing brittle material for grinding, such brittle material having a high moisture content.

BACKGROUND OF THE INVENTION

Difficulties can occur here in the crushing of material for grinding which has a high moisture content and has a strong tendency to sticking and/or caking on above a critical moisture value. In the manufacture of cement there are clay-containing raw material components which do not stick or form deposits at a moisture content below 15%, but on the other hand stick severely and even adhere to vertical walls at a moisture content over 18%.

In the case of ore and diamond-containing volcanic rock too the bulk material properties and thus the behaviour of the material for grinding on feeding into the material bed roll mill worsen to a marked extent above a critical moisture content.

SUMMARY OF THE INVENTION

The object of the invention, therefore, is to provide a method and apparatus capable of satisfactorily crushing material which has a high moisture content and has a strong tendency to sticking and/or caking on above a critical moisture value.

If at least a proportion of the branch stream returned to the roll gap is dried sufficiently before being reintroduced into the roll gap, then a mixed moisture content which lies below the critical moisture content is produced in the roll gap. In this way the bulk material properties and the feed behaviour of the material for grinding is improved decisively and sticking and caking on of the material for grinding in the material bed roll mill is avoided.

By delivering a dried branch stream of the material for grinding to the material bed roll mill a contact drying is also achieved in the roll mill, which makes the drying of the material as a whole considerably easier.

The method according to the invention facilitates simple adaptation to a variable moisture content of the material for grinding which is to be crushed. It is also possible to detect seasonal peaks in the material moisture content by periodic and/or partial drying and to operate the method during the remaining time without heat consumption.

THE DRAWINGS

Three embodiments of the method according to the invention are illustrated in FIGS. 1 to 3, each showing a basic diagram.

FIG. 4 diagramatically illustrates a suitable arrangement of apparatus of the invention.

DETAILED DESCRIPTION

Figure 1:
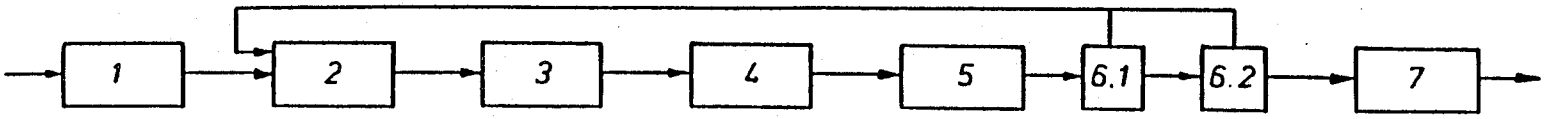

The method diagram according to FIG. 1 contains a stage 1 in which fresh material for grinding is drawn off. This stage 1 can be formed for example by a bunker, on apron conveyor or a screw.

The fresh material for grinding is mixed with returned material for grinding in a stage 2. This stage 2 can be formed for example by a belt, a box feeder or a mixing screw.

The material for grinding is crushed in a stage 3. This stage 3 is formed by a material bed roll mill, the two rolls of which are pressed against one another with a high pressure.

The material for grinding which is crushed in the stage 3 then passes to a stage 4 which serves for breaking up or disagglomeration of the crushed material for grinding. It is formed for example by a hammer mill, an impact mill, a short grinding tube, an edge-runner mixer or a disintegrator.

The disagglomerated material for grinding then passes from the stage 4 into a stage 5 in which the material for grinding is dried. This stage can be formed for example by a pneumatic conveyor dryer, a dispersion dryer or a rotary dryer.

Next the crushed, disagglomerated and dried material for grinding passes into a classification stage which consists of the sub-stages 6.1 and 6.2 which are arranged in a row one behind the other. The sub-stage 1 can be formed for example by a deflecting sifter, the separation limit of which is for example in the range between 200 and 500 μm. The sub-stage 6.2 can be formed by a static sifter or a rotor sifter, the separation limit of which is in the range between 10 and 50 μm or between 20 and 100 μm. The oversize material from both sub-stages 6.1 and 6.2 is returned to the stage 2 and is mixed there with fresh material for grinding before being fed again into the crushing stage.

Finally the finished product is precipitated in a stage 7. This stage 7 can be formed by a cyclone, a filter or by sifter cyclones.

The following parameters are advantageously measured in the individual stages.

in stage 1 the throughout quantity and moisture content of the fresh material for grinding, in stage 2 the drive power and the mixed moisture content, in stage 3 the drive power and the gap width of the material bed roll mill (possibly the moment and the peripheral speed), in stage 4 the drive power of the assembly used for the breaking up or disagglomeration, in stage 5 the gas temperature before and after the dryer and the drive power, in stage 6 the setting of the classifier, the drive power, the division, mass flow and moisture content of the recycled material, in stage 7 the residual moisture content of the product.

Figure 2:
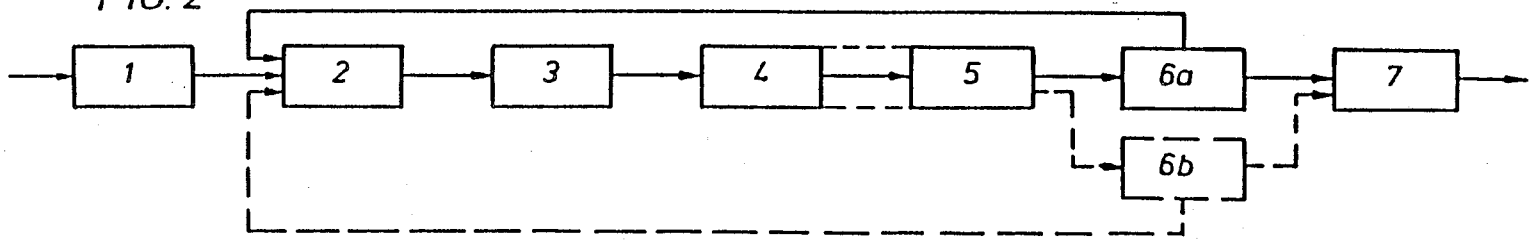

In the method diagram according to FIG. 2 the same reference numerals are used as in FIG. 1 for the same elements.

The stages 4 and 5 here can be combined into one single stage so that the material for grinding which is crushed in the roll gap is simultaneously dried and disagglomerated. A dispersion dryer, possibly with a short grinding part, can for example be used for this.

In addition, in the method diagram according to FIG. 2 two parallel-connected sub-stages 6*a* and 6*b* can be provided in the classification stage, and the oversize material precipitated in the two sub-stages is returned to stage 2. The fine material streams from the sub-stages 6*a* and 6*b* are led together to stage 7 for precipitation of the finished product.

The material discharged for example by force of gravity can be classified in the high-capacity sifter in the sub-stage 6*a* (for instance in a rotor sifter with its own air circulation).

The material discharged with the gas stream can be classified in a static air separator in the sub-stage *6b*.

Here too both classification assemblies, i.e. the sub-stages *6a* and *6b*, can be combined into one.

Figure 3:
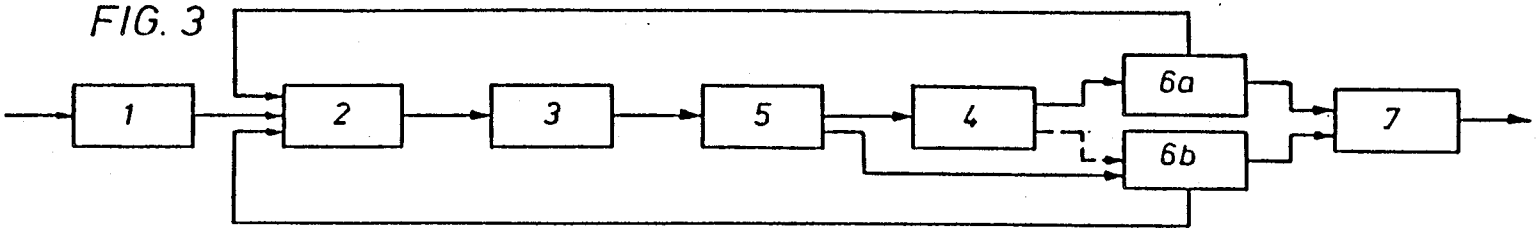

In the method diagram according to FIG. 3 the stages 4 and 5 are arranged in reverse order. Thus the material for grinding which is crushed in stage 3 is first of all dried in stage 5 and then broken up or disagglomerated in stage 4.

The material discharged from stage 4 is delivered some to sub-stage *6a* and some to sub-stage *6b*. The latter also receives a branch stream of the material discharged from stage 5.

The drying assembly used for stage 5 can be in particular a dispersion dryer, an impact dryer or a rotary dryer. Since a certain disagglomeration already occurs in the dryer, this proportion of the dried material is delivered together with the gas stream to the sub-stage *6b* (preferably to a static air separator). The rest of the dried material, which still contains agglomerates, is delivered to stage 4 to be broken up. A hammer or impact mill, a disintegrator, a short tube mill or an edge-runner mixer are particularly suitable assemblies for stage 4.

The material which is broken up in stage 4 is led mechanically to sub-stage *6a* (a sifter). Here too the sub-stages *6a* and *6b* can be combined, for example in the form of a static air separator with partial mechanical material feed.

In purely closed-circuit grinding, i.e. when the total fine material is produced in the material bed roll mill, all of the oversize material is returned to the roll mill. In this case all of the material stream is advantageously dried.

However, in certain circumstances a proportion of the finished material—advantageously a proportion contained in a branch stream of dried but not yet classified material—has to be returned to the roll mill.

Another possibility in the case of a high moisture content of the fresh material for grinding is to operate the material bed roll mill with a level of transformation of energy which is so low and thus with a recycle factor which is so high that with predetermined drying of the crushed material for grinding in the roll gap a mixed moisture content is produced which is below the critical moisture content. Such a case can occur when the feed moisture content is approximately three times the boundary moisture content (i.e. the critical moisture content), but the recycle factor which results from the grinding (at a full level of transformation of energy) is below it, e.g. 2.

Figure 4:
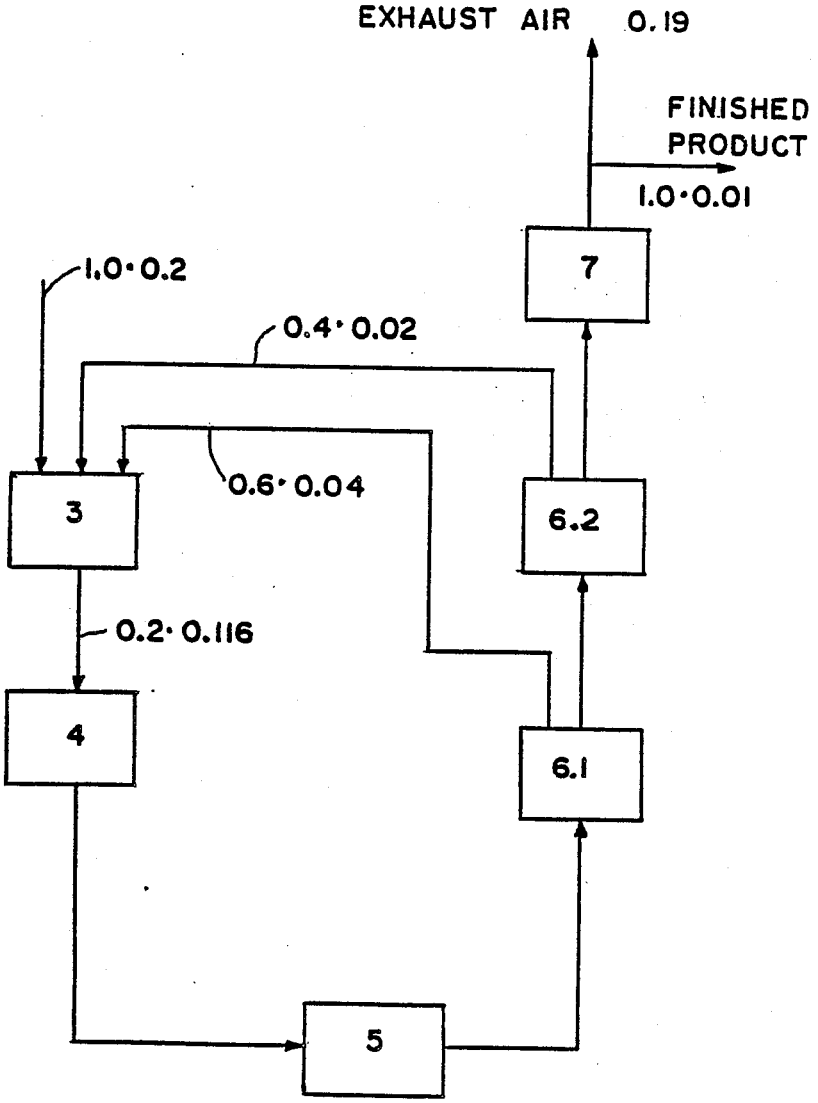

The invention will be explained in greater detail with the aid of two examples. FIG. 4 shows the apparatus diagram on which they are based and corresponds to the variant according to FIG. 1 (the reference numerals used in FIG. 1 for the individual stages are used here).

It may be assumed that the recycle factor determined by the sifting is 2 (which is set by the position of the separation limit).

A material bed roll mill is used for stage 3, a hammer mill for stage 4, a pneumatic conveyor dryer as stage 5, a deflecting sifter as sub-stage 6.1 and s rotor sifter as sub-stage 6.2. Stage 7 is a cyclone.

It may be assumed that the feed moisture content of the fresh material for grinding is 20% and the so-called "boundary moisture content" (i.e. the critical moisture content above which the material for grinding has a strong tendency to sticking and/or caking on) is 12%.

The external moisture balance can then be expressed as follows (in the individual products in each case the first factor represents the material proportion and the second factor the appertaining moisture content):

$$1.0 \cdot 0.2 = 1.0 \cdot 0.01 + 1.0 \cdot 0.19$$

The internal moisture balance (based on stage 3, i.e. the material bed roll mill) is as follows:

$$1 \cdot 0.2 + 0.4 \cdot 0.02 + 0.6 \cdot 0.04 = 2.0 \cdot 0.116$$

This results in a mixed moisture content of 11.6%, which is thus just below the boundary moisture content of 12%.

In the example explained above it is assumed that in sub-stage 6.1 out of the total quantity of circulating material (2.0) a part quantity of oversize material of 0.6 with a moisture content of 4% and in sub-stage 6.2 a further part quantity of 0.4 with a moisture content of 2% are precipitated.

If on the other hand (according to a second example) the basis is taken to be oversize material moisture contents of 2% (after sub-stage 6.1) or 1% (after sub-stage 6.2), this results in a mixed moisture content of 10.8%.

If the boundary moisture content is to be still lower, then the circulation must be artificially raised, which can be achieved for example by branching off an unclassified branch stream after stage 5 (pneumatic conveyor dryer).

The internal moisture balance of stage 5 in the first example is as follows:

$$2.0 \cdot 0.116 + 0.19 + 0.01 \cdot 1 + 0.4 \cdot 0.02 + 0.6 \cdot 0.04$$

What is claimed is:

1. The method of crushing fresh brittle material to prepare said material for grinding, said fresh material having a moisture content higher than a critical value above which satisfactory crushing is inhibited, said method comprising:

(a) pre-mixing selected proportions of said fresh brittle material in a pre-mixing stage with selected proportions of at least partially processed other material having a moisture content sufficiently lower than that of said fresh material to reduce the moisture content of all the resultant pre-mixed material to a value no greater than said critical value;

(b) crushing said pre-mixed material; and (c) thereafter disagglomerating, drying, and classifying said crushed pre-mixed material in a selected sequence.

2. The method of claim 1 including determining the initial moisture content of said fresh brittle material; determining a boundary moisture content of finished crushed material which must not be exceeded; determining the moisture content of said partially processed other material; and selecting the proportion of said partially processed other material to be pre-mixed with said brittle material.

3. The method of claim 2 including first disagglomerating and then drying the crushed pre-mixed material.

4. The method of claim 2 including first drying and then disagglomerating the crushed pre-mixed material.

5. The method of claim 2 including simultaneously disagglomerating and drying the crushed pre-mixed material.

6. The method of claim 2 including selecting said partially processed other material from oversize material resulting from the classifying step.

7. The method of claim 2 including selecting said partially processed other material at least in part from crushed pre-mixed material which has been dried but not classified.

8. The method of claim 2 wherein the classifying step includes two stages arranged one after the other, oversize material from both of said stages forming at least a part of said partially processed other material.

9. The method of claim 2 wherein the classifying step includes two stages arranged in parallel relation, oversize material from both of said stages forming at least a part of said partially processed other material.

10. Apparatus for crushing fresh brittle material having a high moisture content, said apparatus comprising:

a source of said fresh brittle material;

mixing means in communication with said source and in communication with a supply of partially processed other material to provide a mixture of said fresh brittle material and said partially processed other material which mixture exhibits a reduced, acceptable overall moisture content;

a mill in communication with said mixing means for receiving said mixture and crushing it;

disagglomeration means for receiving and disagglomerating said crushed mixture;

dryer means for receiving and drying said crushed mixture;

communication means for placing a selected one of said disagglomerating means and dryer means in direct communication with said mill;

classifying means in communication with the selected one of said disagglomerating means and dryer means for receiving said mixture therefrom; and further communication means between said classifying means and said mixing means for supplying oversize material to said mixing means for supplying said partially processed other material.

11. The apparatus of claim 10 wherein said disagglomerating means is in direct communication with said mill and said dryer means is between said disagglomerating means and said classifying means.

12. The apparatus of claim 10 wherein said dryer means is in direct communication with said mill and said disagglomerating means is between said dryer means and said classifying means.

13. The apparatus of claim 10 wherein said disagglomerating means and said dryer means are combined and are in direct communication with said mill.

14. The apparatus of claim 10 wherein said classifying means includes two stages.

15. The apparatus fo claim 14 wherein said stages are sequential.

16. The apparatus of claim 14 wherein said stages are parallel.

* * * * *